US007451813B1

(12) United States Patent
Day

(10) Patent No.: US 7,451,813 B1
(45) Date of Patent: Nov. 18, 2008

(54) SYSTEM AND METHOD FOR BLEEDING OFF PRESSURE FOLLOWING SERVICING A WELL

(75) Inventor: Mark Alexander Day, Rocky Mountain House (CA)

(73) Assignee: Schlumber Technology Corporation, Sugar Land, TX (US)

( * ) Notice: Subject to any disclaimer, the term of this patent is extended or adjusted under 35 U.S.C. 154(b) by 0 days.

(21) Appl. No.: 12/041,842

(22) Filed: Mar. 4, 2008

(51) Int. Cl.
*E21B 43/00* (2006.01)

(52) U.S. Cl. ..... 166/267; 166/311

(58) Field of Classification Search ..... 166/267, 166/368, 311, 75.12
See application file for complete search history.

(56) References Cited

U.S. PATENT DOCUMENTS 6,755,255 B2 * 6/2004 Wade et al. ..... 166/369

2008/0006304 A1 * 1/2008 Treherne et al. ..... 134/34

* cited by examiner

*Primary Examiner*—William P Neuder
(74) *Attorney, Agent, or Firm*—Robert A. Van Someren; Wayne I. Kanak

(57) ABSTRACT

A technique facilitates release of pressure from a well, and/or surface treating lines, via a bleed-off mechanism. The bleed-off mechanism is in fluid communication with a flow path extending from a wellhead valve or wellbore and designed for connection with a vacuum truck. The bleed-off mechanism can be opened to enable venting of trapped pressure from the wellbore and/or flow path. The bleed-off mechanism is also designed to contain any liquid that escapes during release of the trapped pressure. Once the pressure is relieved, the vacuum truck can be used to clean out fluid from the wellbore and/or surface treating lines without exposure to excess pressure.

26 Claims, 3 Drawing Sheets

SYSTEM AND METHOD FOR BLEEDING OFF PRESSURE FOLLOWING SERVICING A WELL

BACKGROUND OF THE INVENTION

A variety of well treatments are conducted when servicing wells to improve productivity. For example, well fracturing treatments are conducted in which fracturing fluid is pumped downhole under pressure. Upon completion of the well treatment, the fluid is removed from the well. However, the fluid still may be under substantial pressure which must be bled off. In some applications, flare pits or testers can be used to bleed off the trapped pressure. In other environments and applications, however, no flare pits or testers are available.

In the latter scenario, a vacuum truck typically is connected to the high pressure iron, e.g. surface treating lines, and the trapped pressure is allowed to slowly bleed off. However, the vacuum truck and vacuum hoses do not provide optimal control over release of this excess pressure.

BRIEF SUMMARY OF THE INVENTION

In general, the present invention provides a system and a method for providing a bleed-off mechanism in fluid communication with a flow path extending from the wellbore and designed for connection with a vacuum truck. The bleed-off mechanism can be opened to enable release of pressure by venting fluid that is under excess pressure within the wellbore and/or flow path. The bleed-off mechanism is also designed to contain any liquid that escapes to the bleed-off mechanism. Once the trapped pressure is relieved, the well service fluid in the wellbore and/or flow path can be cleaned out via the vacuum truck.

BRIEF DESCRIPTION OF THE DRAWINGS

Certain embodiments of the invention will hereafter be described with reference to the accompanying drawings, wherein like reference numerals denote like elements, and.

DETAILED DESCRIPTION OF THE INVENTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and method for breaking the containment between high pressure iron, e.g. surface treating lines, and a low pressure vacuum truck when removing well treatment fluid from a wellbore. Following a well treatment process, such as a fracturing process, well treatment fluids remain in the surface treating lines and must be removed. In many well treatment operations, however, the well treatment fluid is delivered downhole under substantial pressure and this pressure may be retained. The present system and method enables the bleeding off of this retained pressure to atmosphere via a bleed-off mechanism. Simultaneously, the bleed-off mechanism can be used to contain any liquids expelled while venting the excess pressure to atmosphere. The contained liquid is removed to an appropriate containment vessel, such as a vacuum truck. Once the excess pressure is relieved, the vacuum truck can be used to complete the removal of well treatment fluid from the surface treating lines. By way of example, the vacuum truck can be coupled to a manifold positioned in the flow path along which fluid flows from the well to the vacuum truck.

Figure 1:
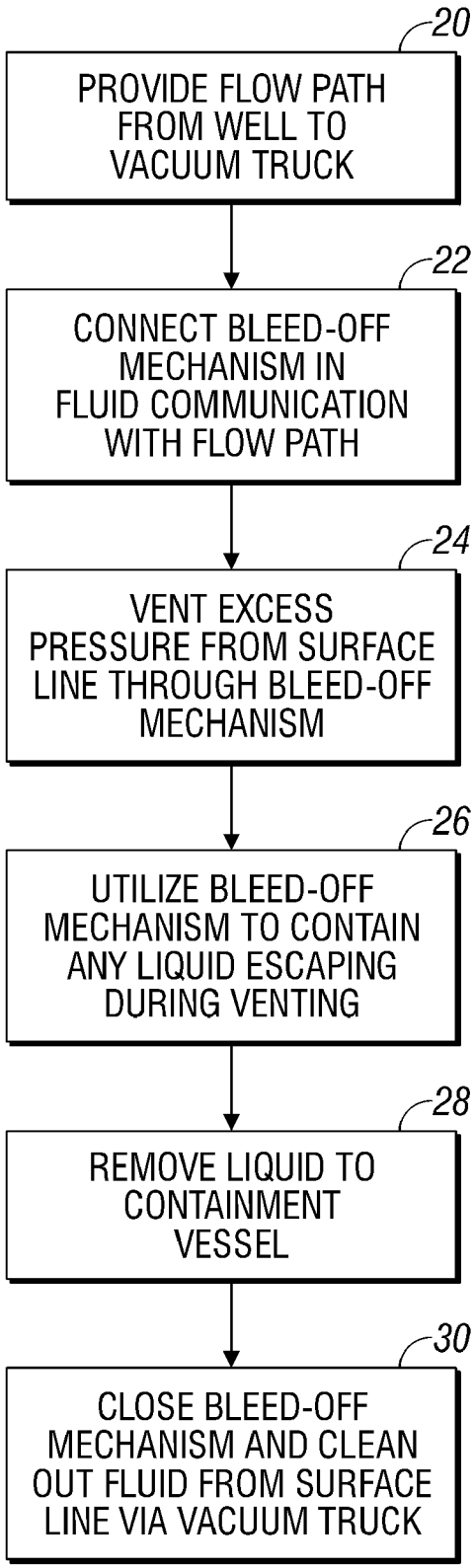
FIG. 1 is a flow chart illustrating a method for breaking the containment between a high pressure wellbore and/or flow path and a low pressure vacuum truck, according to an embodiment of the present invention.

One approach for breaking the containment between the well and the vacuum truck by venting any excess pressure is illustrated by the flow chart of FIG. 1. As illustrated, a flow path is provided from the well to a vacuum truck or other containment vessel, as illustrated by block 20. The flow path may be created by surface piping that is coupled to the high pressure tubing within the wellbore. The high pressure tubing within the wellbore may comprise coiled tubing, jointed tubing, casing, or other types of tubing deployed in the wellbore and used to conduct fluid flow for a given well servicing operation.

The method also comprises connecting a bleed-off mechanism in fluid communication with the flow path, as illustrated by block 22. As discussed in greater detail below, the bleed-off mechanism can be connected in line with the flow path by coupling the mechanism to the surface piping via an appropriate manifold. Use of the manifold is one way of enabling selective collection of liquid by the vacuum truck during both the venting process and the process of removing the remaining fluid from the wellbore and/or flow path following the venting process. As illustrated in block 24, any excess pressure within the surface treating lines can be vented through the bleed-off mechanism in a controlled manner.

Simultaneously, the bleed-off mechanism can be used to fully contain any liquid escaping during the venting process, as illustrated by block 26. For example, the release of excess pressure from the surface treating lines can result in the expulsion of both gas and liquid through the surface piping and into the bleed-off mechanism. The liquid expelled under high pressure often has substantial velocity and energy which is dissipated by the bleed-off mechanism while the liquid is contained by the bleed-off mechanism once the energy is dissipated.

The contained liquid can be removed from the bleed-off mechanism and delivered to an appropriate containment vessel, as illustrated by block 28. The containment vessel can be the vacuum truck utilized in removing fluid from the wellbore. For example, the vacuum truck can be connected to the bleed-off mechanism, and vacuum can be applied to remove the liquid expelled into the bleed-off mechanism during the venting process.

Upon venting of the excess pressure from the surface treating lines, the vacuum truck is connected in a manner that enables the cleaning out of fluid from the well and/or surface treating lines, as illustrated by block 30. In one example, the bleed-off mechanism is closed off from the surface piping, and the surface piping is used to direct the flow of fluid to the vacuum truck. Although this procedure can be accomplished in a variety of ways, one method involves closing off the bleed-off mechanism with a valve and moving a vacuum hose from the bleed-off mechanism to an appropriate port on the manifold. The vacuum truck can then be used to apply a vacuum via the vacuum hose and to remove the well servicing fluid from the wellbore and/or surface piping.

Figure 2:
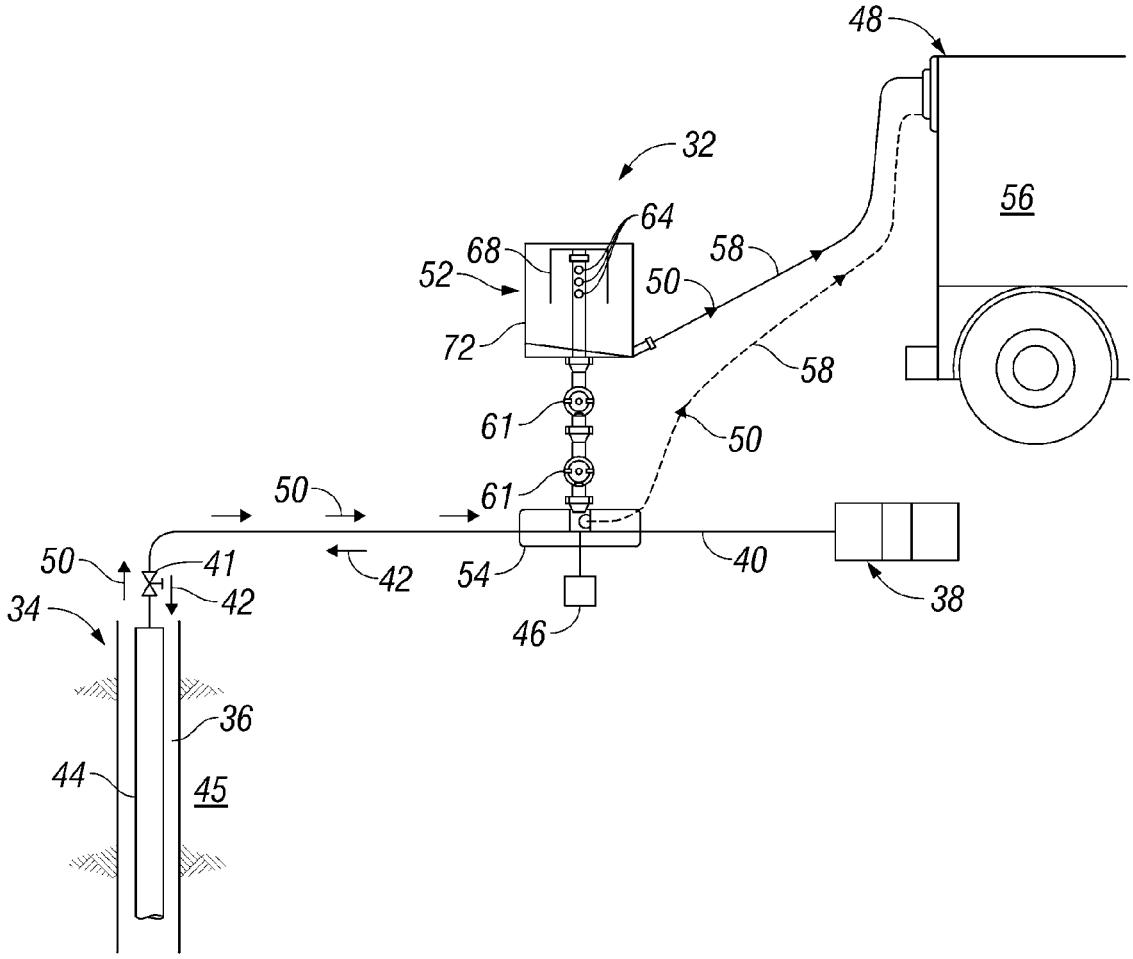
FIG. 2 is a schematic illustration of a system utilizing a bleed-off mechanism, according to an embodiment of the present invention.

Referring generally to FIG. 2, one example of a well servicing system 32 is illustrated. In this embodiment, a well 34 is serviced by pumping a well service fluid downhole into a wellbore 36. The fluid is pumped downhole by a suitable pump 38 that may be positioned at a surface location to deliver the fluid through a conduit 40, e.g. piping, and a wellhead valve 41 in the direction indicated by arrows 42. By way of example, the well service fluid may comprise a fracturing fluid pumped downhole under pressure via a tubing 44 to fracture a surrounding formation 45. Tubing 44 may comprise a service string used to deliver the fracturing fluid to a desired region within wellbore 36. However, a variety of other well servicing operations can be performed, and other types of fluid may be pumped downhole to facilitate a particular well servicing operation. The pressure of the well servicing fluid may be measured by one or more pressure sensors 46.

Upon completion of the fracturing or other well servicing operation, the well service fluid is removed into a vacuum truck 48. However, before exposing vacuum truck 48 to the potential pressures of the well servicing fluid utilized in wellbore 36, the excess pressure is vented. As illustrated by arrows 50, a flow path is created between the wellhead valve 41, which is normally closed to isolate tubing 44, and vacuum truck 48. In this example, conduit 40 can be used, at least in part, to create flow path 50 with fluid flow moving in a direction opposite to the flow or fluid through conduit 40 during the fracturing or other well servicing operation.

A bleed-off mechanism 52 is connected in fluid communication with flow path 50. For example, bleed-off mechanism 52 may be connected to conduit 40 via a manifold 54. However, other types of flow conduits and connection mechanisms can be utilized in coupling bleed-off mechanism 52 in line with flow path 50. Bleed-off mechanism 52 is able to relieve excess pressure within conduit 40, tubing 44, and wellbore 36 by venting the excess pressure to atmosphere while containing any liquid that moves into bleed-off mechanism 52 during the venting process. Although it is not intended to routinely bleed off wellbore pressure, it is possible to do so with the equipment of the present invention. The liquid that moves into bleed-off mechanism 52 can be removed to an appropriate containment vessel 56. In the example illustrated, containment vessel 56 is vacuum truck 48 connected to bleed-off mechanism 52 by, for example, an appropriate vacuum hose 58. Once the venting operation is completed, the vacuum hose 58 can be reconnected at an appropriate location, e.g. manifold 54, to continue the removal of fluid from conduit 40 and, if desired, tubing 44 and wellbore 36. The repositioned vacuum hose 58 is illustrated as a dashed line in FIG. 2.

Figure 3:
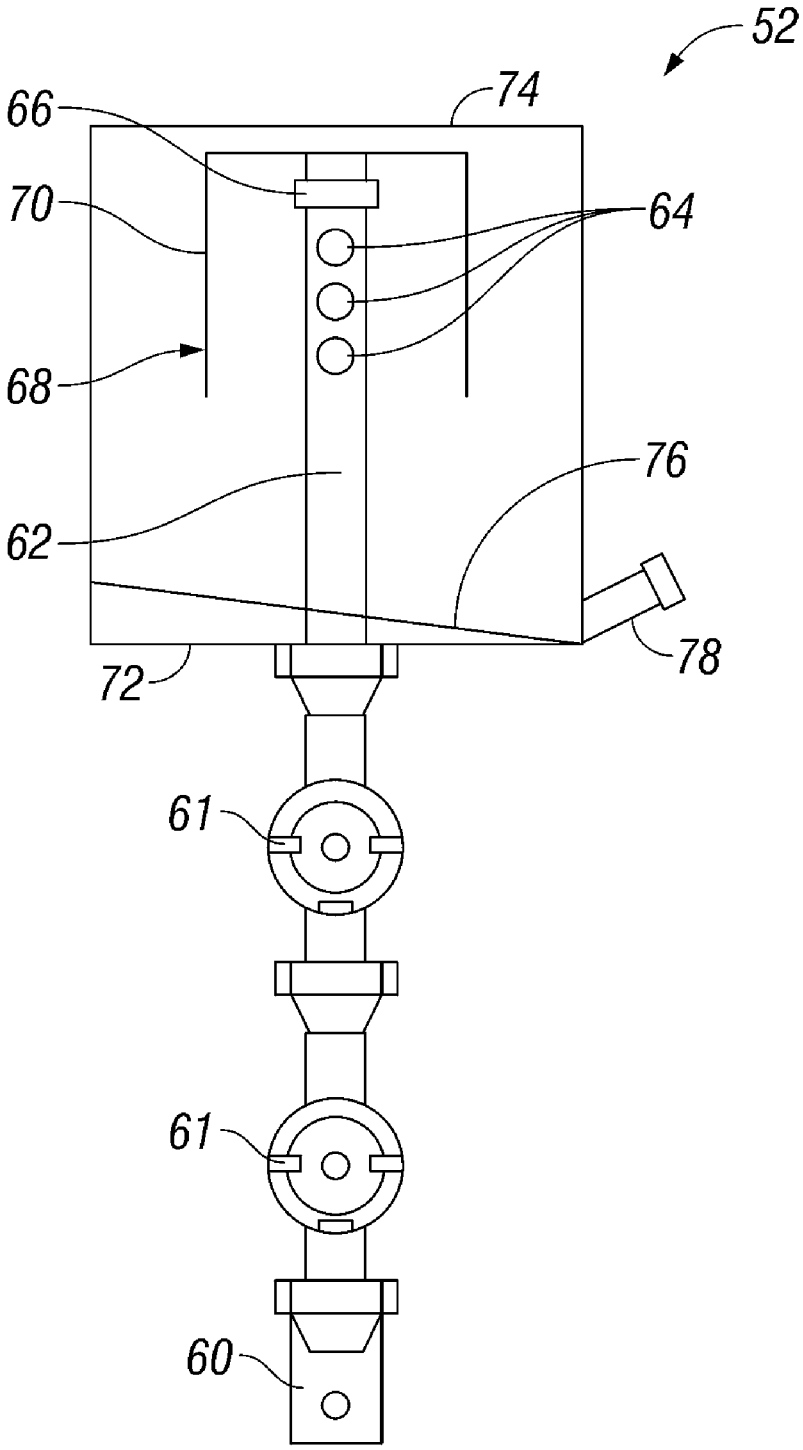
FIG. 3 is an enlarged view of the bleed-off mechanism illustrated in FIG. 2, according to an embodiment of the present invention.

With additional reference to the enlarged view found in FIG. 3, one embodiment of the bleed-off mechanism 52 is illustrated. In this embodiment, bleed-off mechanism 52 comprises a connection region 60 by which bleed-off mechanism 52 and manifold 54 may be connected. The flow of fluid into bleed-off mechanism 52 during venting of pressure from conduit 40 and, potentially, tubing 44 and wellbore 36, may be controlled via one or more bleed valves 61 that control flow along a conduit 62 that leads to a vent 64. In the example illustrated, conduit 62 comprises a pipe, and vent 64 comprises one or more openings formed through a side wall of the pipe 62. Conduit or pipe 62 is terminated at a cap 66 that blocks further flow along conduit 62 to thereby direct the flow of fluid and release of pressure through the vent 64.

The energy and velocity of the fluid exiting vent 64 is dissipated by a blocking member 68. In the embodiment illustrated, blocking member 68 comprises a shroud 70 positioned around the region of conduit 62 having vent openings 64. Accordingly, the high pressure fluid exiting vent 64 is directed against the inside surface of shroud 70 which dissipates the energy and velocity of the fluid. Any liquid exiting vent 64 under sufficient pressure is blocked by shroud 70 and simply drops into the bottom of a separator body 72. In the example illustrated, separator body 72 is open to atmosphere by virtue of, for example, an open top 74 that enables the venting of conduit 40 and, potentially, well 34, to atmosphere without loss or spillage of any liquid. The separator body 72 also may comprise a sloped bottom 76 that is oriented to have an incline directing contained liquid to an appropriate fitting 78. Fitting 78 is designed for coupling with an appropriate conduit to deliver the collected liquid to a proper containment vessel. For example, fitting 78 may be designed for coupling with vacuum hose 58 such that vacuum truck 48 can be used to apply a vacuum and remove the contained liquid from separator body 72. Accordingly, the flow path 50 extends to bleed-off mechanism 52, where any excess pressure is vented to atmosphere, and then continues to vacuum truck 48.

When a well treatment is completed and it is necessary to remove servicing fluid from the surface treating lines (conduit 40), the excess pressure is initially removed via bleed-off mechanism 52. In one operational embodiment, vacuum truck 48 or another containment vessel is connected to the fitting 78. A vacuum is then applied via, for example, vacuum truck 48 which creates suction at fitting 78. The bleed valve or valves 61 are then slowly opened to bleed any trapped pressure/fluid into separator body 72. The fluid released into separator body 72 typically comprises a liquid/gas mixture.

The trapped pressure is released upwardly through valves 61 along conduit 62 until stopped by high pressure cap 66 which directs the pressure release through vent 64. The high pressure gas and/or liquid is directed outwardly against blocking member 68, e.g. shroud 70, which dissipates the velocity and thus the energy of the high pressure fluid. The fluid then drops downwardly from shroud 70 toward the bottom of separator body 72. The gas phase is vented to atmosphere as it moves out of the separator body through, for example, open top 74. The liquid phase drops to the bottom of separator body 72 and is directed by the force of gravity to fitting 78. The suction applied to fitting 78 via vacuum hose 58 removes the liquid from the interior of separator body 72 and directs it into the appropriate containment vessel 56.

Once the pressure is bled off and the liquid is removed from the bleed-off mechanism 52, the remaining fluid can be safely removed from conduit 40 and, if necessary, tubing 44 and wellbore 36. According to one embodiment, vacuum hose 58 is simply moved from fitting 78 to an appropriate coupling on manifold 54 below bleed valves 61. Because the surface treating lines no longer contain excess pressure, the well servicing fluid can be cleaned out via vacuum truck 48. If all excess pressure has been removed from conduit 40, the bleed valves 61 can be returned to a closed position. In other embodiments, separate vacuum hoses 58 can be connected to an appropriate valve or manifold to eliminate the need to move a single vacuum hose from fitting 78 to manifold 54. Additionally, other types of manifolds, conduits, valving, and fluid flow control structures can be utilized in removing liquid from bleed-off mechanism 52 and from conduit 40 and wellbore 36.

Following removal of the well treatment fluid, the bleed-off mechanism 52 and manifold 54 can be reset to a pumping configuration to enable performance of another well treatment operation. Upon completion of the subsequent well treatment operation, the bleed-off mechanism 52 can again be used to relieve excess trapped pressure before conducting a cleanout procedure. By utilizing bleed-off mechanism 52, all pressure is contained within conduits, e.g. piping, designed to withstand the high pressures that may be retained from the well treatment operation. Furthermore, the bleed-off mechanism 52 fully contains vented liquids to avoid any environmental issues without increasing the time associated with a given well treatment operation.

The system illustrated and described above can be utilized with a variety of well treatment operations and cleanout procedures. Additionally, the bleed-off mechanism can be constructed with additional or alternate components and with components of different sizes depending on the environment and specific application. Furthermore, a variety of manifolds, vacuum sources, and containment vessels can be incorporated into the overall system and method.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system to bleed off pressure, comprising:

a tubing deployed in a wellbore;

a vacuum truck to remove fluid from the wellbore during cleaning of the wellbore following a well treatment;

a fluid transfer conduit to transfer fluid from the tubing in the wellbore to the vacuum truck; and a bleed-off mechanism coupled to the fluid transfer conduit, the bleed-off mechanism comprising a vent open to atmosphere to relieve pressure and a separator body able to prevent loss of liquid during venting of pressure from the fluid transfer conduit.

2. The system as recited in claim 1, wherein the bleed-off mechanism comprises a pipe having the vent, and a shroud surrounding a portion of the pipe containing the vent.

3. The system as recited in claim 1, wherein the bleed-off mechanism comprises a fitting coupling the interior of the separator body with a containment vessel.

4. The system as recited in claim 1, wherein the bleed-off mechanism comprises a valve positioned between the vent and the fluid transfer conduit.

5. The system as recited in claim 3, wherein the separator body comprises a sloped bottom oriented to gravity feed the liquid to the fitting.

6. The system as recited in claim 2, wherein the shroud is positioned in the separator body and the separator body has an open top.

7. A method of bleeding off pressure, comprising:

mounting a bleed-off mechanism in fluid communication with the flow path between a wellhead and a vacuum truck;

applying suction with the vacuum truck;

opening a valve of the bleed-off mechanism to enable venting of fluid under excess pressure through the bleed-off mechanism;

containing any liquid escaping to the bleed-off mechanism; and cleaning out fluid from the flow path via the vacuum truck.

8. The method as recited in claim 7, further comprising exposing the fluid under excess pressure to atmosphere through a vent.

9. The method as recited in claim 8, further comprising surrounding the vent with a shroud to dissipate the energy of the fluid passing through the vent.

10. The method as recited in claim 9, further comprising placing the shroud within a separator body to contain any liquid expelled through the vent.

11. The method as recited in claim 10, further comprising draining the separator body through a fitting.

12. A method, comprising:

connecting a vacuum truck to a well via a bleed-off mechanism;

removing excess pressure from the well via the bleed-off mechanism connected in line with a fluid flow path from the well to the vacuum truck; and drawing fluid from the well into the vacuum truck without exposing the vacuum truck to the excess pressure.

13. The method as recited in claim 12, further comprising injecting a fluid into the well to perform a well treatment operation prior to cleaning out the fluid with the vacuum truck.

14. The method as recited in claim 12, wherein connecting the vacuum truck comprises applying a vacuum with the vacuum truck.

15. The method as recited in claim 12, further comprising containing any liquid passing through the bleed-off mechanism.

16. The method as recited in claim 12, wherein removing excess pressure from the well comprises opening a valve of the bleed-off mechanism to the pressure of the well.

17. The method as recited in claim 16, wherein removing excess pressure from the well comprises directing fluid flowing through the valve into a pipe having a vent; and routing the fluid out of the vent against a shroud.

18. The method as recited in claim 17, wherein removing excess pressure from the well comprises positioning the shroud in a separator body open to atmosphere.

19. The method as recited in claim 12, wherein drawing fluid from the well comprises moving a suction hose of the vacuum truck to a cleanout position to remove fluid from the well.

20. A system, comprising:

a well having a wellhead valve;

a fluid transfer conduit located at a surface location and coupled in fluid communication with the wellhead valve;

a manifold connected to the fluid transfer conduit; and a bleed-off mechanism coupled to the manifold to relieve excess pressure from the fluid transfer conduit prior to cleanout of fluid with a vacuum truck.

21. The system as recited in claim 20, further comprising a vacuum truck coupled to the bleed-off mechanism during relief of the excess pressure.

22. The system as recited in claim 20, wherein the bleed-off mechanism comprises a vent open to atmosphere and a separator body able to contain liquid expelled through the vent.

23. The system as recited in claim 22, wherein the bleed-off mechanism comprises a pipe having the vent, and a shroud surrounding a portion of the pipe containing the vent.

24. The system as recited in claim 23, wherein the bleed-off mechanism comprises a fitting coupling the interior of the separator body with a containment vessel.

25. The system as recited in claim 24, wherein the containment vessel is the vacuum truck.

26. The system as recited in claim 24, wherein the shroud is positioned in the separator body and the separator body has an open top.

* * * * *